United States Patent [19]
Jackson

[11] 4,258,600
[45] * Mar. 31, 1981

[54] VARIABLE UTILITY CHAIN SAW APPARATUS

[76] Inventor: Edward L. Jackson, Pauls Valley, Okla. 73075

[ * ] Notice: The portion of the term of this patent subsequent to Nov. 28, 1995, has been disclaimed.

[21] Appl. No.: 958,932

[22] Filed: Nov. 8, 1978

Related U.S. Application Data

[63] Continuation-in-part of Ser. No. 741,716, Nov. 16, 1976, Pat. No. 4,127,046.

[51] Int. Cl.³ ..... B27B 17/08
[52] U.S. Cl. ..... 83/574; 83/743; 83/745; 83/796
[58] Field of Search ..... 83/745, 743, 796, 798, 83/574, 794, 797

[56] References Cited

U.S. PATENT DOCUMENTS

| | | | |
|---|---|---|---|
| 1,123,783 | 1/1915 | Muir | 83/798 |
| 2,851,067 | 9/1958 | Greenslate | 83/796 |
| 2,974,694 | 3/1961 | Mattila et al. | 83/745 |
| 4,127,046 | 11/1978 | Jackson | 83/798 |

FOREIGN PATENT DOCUMENTS

| | | | |
|---|---|---|---|
| 495132 | 4/1930 | Fed. Rep. of Germany | 83/743 |

*Primary Examiner*—Donald R. Schran
*Attorney, Agent, or Firm*—William R. Laney

[57] ABSTRACT

A variable utility chain saw apparatus which includes a mounting frame, a mounting plate removably carried in the mounting frame and a portable chain saw secured to one side of the mounting plate and including a saw blade guide plate which projects through a slot in the mounting plate and supports and guides a flexible saw blade. A chain saw guard subassembly is pivotally connected to the mounting plate to protectively shield the saw blade without interfering with the sawing function of the blade. A supporting assembly adapted for securement to a cylindrical structure is detachably fastened to a support flange which is secured to, and projects from, the mounting frame. The supporting assembly can take several forms to facilitate usage of the saw apparatus for accomplishing several precision sawing functions in the field or at a workbench, all in addition to the customary manual usages of a conventional portable chain saw.

10 Claims, 15 Drawing Figures

VARIABLE UTILITY CHAIN SAW APPARATUS

RELATED APPLICATIONS

This application is a continuation-in-part of my U.S. patent application Ser. No. 741,716, filed Nov. 16, 1976, and entitled "Combination Portable and Stationary, Bench-Mounted Chain Saw Apparatus", now U.S. Pat. No. 4,127,046.

BACKGROUND OF THE INVENTION

1. Field of the Invention

This invention relates to sawing apparatus, and more particularly, to an apparatus which widely increases the versatility and variability of usage of standard portable chain saws by adapting such saws to utilization for making various precision cuts on trees, logs and the like in the field, and also in adapting the chain saw to use in effecting substantially horizontal precision cuts in a workpiece supported on a workbench.

2. Brief Description of the Prior Art

Chain saws are highly effective cutting devices for field work in felling trees and trimming limbs therefrom, as well as other sawing tasks which involve cutting through relatively large wooden members which are stationarily located and in situations where the main objective is severance of the member without particular regard to the precise angle or orientation of the cut. Generally, chain saws as presently constructed are portable, and include a handle by which the saw can be lifted and manipulated and some type of guard element. While the construction of chain saws varies considerably, they generally include a chain saw blade supporting and guiding plate upon which the saw blade tracks and is supported during the cutting operation. The majority of chain saws previously manufactured and sold have also included some type of guard structure intended to function to prevent contact with the saw blade during its high speed movement, and thereby prevent injury to the user. Most chain saws, even the smallest, are relatively heavy, and such weight makes it difficult to manually use a chain saw to effect cutting through a precisely predetermined plane, or at a predetermined angle with respect to a workpiece surface. Moreover, the weight and method of construction are such that it is often extremely difficult to cut small, unsupported or unanchored pieces of wood with this type of saw. In general, these characteristics make chain saws unsuited for home use in craft projects, or in carpentry operations where precision cutting of relatively small wooden workpieces is entailed. Conventional chain saws are also not adapted for field usage where a log or other structural member is to be notched or cut through in a precise plane for purposes of use in construction projects or the like.

Various types of stationary bench-mounted saw devices have previously been manufactured for providing the cutting capacity and power inherent in chain saw structures, yet permitting more or less precision cutting as required in carpentry, and for many types of home crafts. Thus, certain types of radial saws as well as band saws have been provided on various types of jigs or stands and have been susceptible to movement in several planes to effect cutting in different planes in order to produce mitered cuts, or preselected bias cuts, in various sizes of workpieces. In general, however, most of the types of saw structures which have been provided for such usage have not been susceptible to transport to field locations where they may be manipulated by hand—that is, readily located, used and relocated at will in any location which may be desired by the user. Moreover, such structures are, in general, entirely unsuited to felling and trimming trees. On the other hand, chain saw structures as they are now known, while portable and suitable for a variety of field uses, cannot be adapted in such locations to use for notching timbers, for mitering, as a beam slabbing apparatus or for any similar functions. The hand-held portable chain saws are not sufficiently stable, or precisely locatable manually, to facilitate such cutting and, of course, in most instances no structures are present which afford a stable platform to which such chain saws can be secured to give the required stability to perform the described types of cutting operations.

In an effort to realize some of the advantages of portability and the concomitant flexibility in types of field cutting which is characteristic of chain saw utilization, and also to permit bench mounting of similar types of saws, various proposals have been heretofore made for detachably or temporarily mounting various kinds of portable power saw equipment on supporting platforms or jigs to permit them to be held steadily and stationarily at a fixed location in order to effect a desired angle of cut, or a particular sawing operation. Some of these types of structures have included platforms or stands upon which chain saws can be mounted, and others have contemplated a demountable, temporary support of radial saws or other types of saws. Examples of patents which depict and describe a chain saw mounting structure for permitting a chain saw to be used as a table saw in woodworking and carpentry are U.S. Pat. No. 2,851,067; U.S. Pat. No. 1,123,783; French Pat. No. 1,384,843; German Pat. No. 740,065; French Pat. No. 1,031,907; Swiss Pat. No. 374,192, and German Pat. No. 690,791. In the case of all these patents, however, the structure in which the chain saws are mounted to permit a table sawing application to be achieved are such that the mounting of the saw in the structure for effecting a desired cut is time-consuming, and requires several manipulations using various types of hand tools. Moreover, the types of cuts, as well as the sorts of workpieces which can be cut with the structure as thus provided, are, in all cases, limited to certain specialized cutting operations. Thus, the chain saw mounting stand shown in French Pat. No. 1,384,843 is, in reality, best adapted and utilized primarily for cutting logs into relatively short segments (such as firewood), and is unsuited for cutting mitered cuts along a particular, preselected angle. The same limitation is characteristic of the saw mounting framework shown in German Pat. No. 690,791.

In Greenslate U.S. Pat. No. 2,851,067, cutting is effected by upward movement of the saw blade through the workpiece located on the top of a supporting table, and it is not possible to perceive the line of cut of the blade as it enters the workpiece from its underside. Cutting of the saw is also limited to a single vertical plane in the case of the Greenslate table-mounted chain saw structure.

The endless chain saw shown in Muir U.S. Pat. No. 1,123,783 is actually not a dual functioning type of apparatus in that the chain saw there illustrated, while platform mounted, cannot be removed and made portable for field usage. It is true that the platform upon which the chain saw blade is mounted in the Muir structure is mounted upon skids and thus constitutes a type of sled, but hand portability and ability to manually use the chain saw in the field are not characteristic of this structure.

In U.S. Pat. No. 3,433,277 to Ripley, a foldable saw buck is provided which includes a trough for holding a log, timber or other workpiece so that an end portion of the log can extend beyond the trough. There is then provided a pivotable platform upon which a portable chain saw can be clamped, and the platform then pivoted in such a way that the saw blade is caused to move through a plane which intersects and extends through the log or workpiece at a location beyond the end of the trough. This particular arrangement, while affording stability to the chain saw, does not facilitate the use of the chain saw in a field location for making precision cuts, since it would be impractical to transport the entire foldable saw buck to the field location. Moreover, the saw buck is intended to be bolted or otherwise clamped and secured to a floor or other supporting surface. Further, this apparatus has no capability of making mitered cuts, or any other cut orientation except at substantially a right angle to the axis of the workpiece or log.

BRIEF DESCRIPTION OF THE PRESENT INVENTION

The present invention provides a variable utility chain saw which has multiple modes of operation, including a group of usages to precisely cut and notch workpieces in the field or upon a stationary work bench, and also, the usual relatively light weight, portable usage normally characteristic of conventional chain saws.

Broadly described, the variable utility chain saw apparatus of the invention includes a mounting frame, a mounting plate removably carried in the mounting frame and a portable chain saw mounted on the mounting plate. The usual motor and chain saw handle are disposed on one side of the mounting plate, and the blade and its conventional guide plate project through the mounting plate and extend outwardly from the opposite side thereof. A chain saw guard subassembly is pivotally connected to the mounting plate to protectively shield the saw blade without interfering with the sawing function of the blade. A supporting assembly adapted for securement to a stationary structure is detachably fastened to a support flange which is secured to, and projects from, the mounting frame. The supporting assembly can take several forms to facilitate usage of the saw apparatus to accomplish several selected precision sawing functions in the field or at a workbench, all in addition to the customary manual usages of a conventional portable chain saw.

An important object of the invention is to provide a versatile, variable use sawing apparatus.

A further object of the invention is to provide an apparatus which enables a conventional chain saw to be stabilized and precisely positioned to transversely cut a log or timber in the field, or to notch such a log in the field by cutting in a precisely determined plane extending parallel to the longitudinal axis of the log.

Another object of the invention is to provide an attachment for portable chain saws which will permit such saws to be quickly fixed to a log or other member to be cut in a stable attitude, and aligned to make a precise cut on the log or other member to which the saw is attached.

An additional object of the invention is to provide a versatile, variable utility chain saw apparatus which includes relatively few moving parts, is suited for field or bench use, and is characterized in having a long and trouble free operating life.

Further objects and advantages of the invention will become apparent as the following detailed description of preferred embodiments of the invention is read in conjunction with the accompanying drawings which illustrate such preferred embodiments.

GENERAL DESCRIPTION OF THE DRAWINGS

FIG. 6 is a detail view illustrating, in side elevation, a chain tensioning subassembly included in the chain saw apparatus of the invention.

Figure 10:
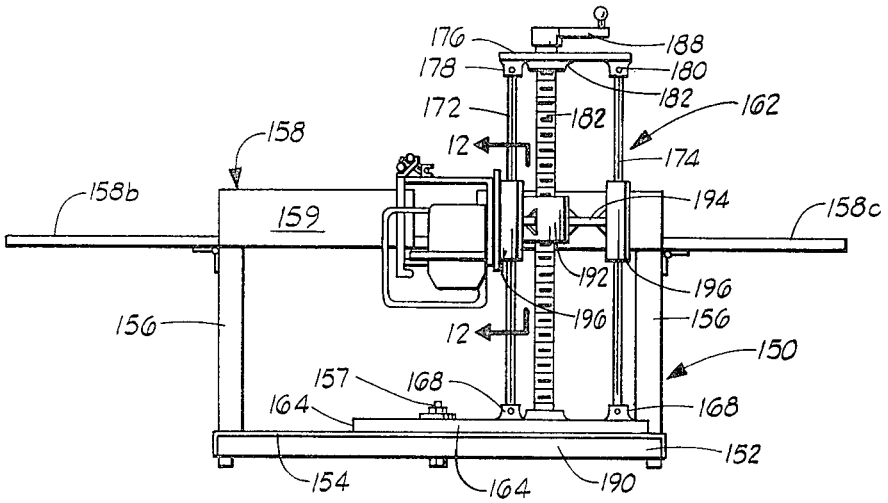
FIG. 10 is a side elevation view of yet another embodiment of the invention, illustrating the variable utility chain saw apparatus as it is employed in a bench mounting for effecting cuts through a bench supported workpiece in a horizontal plane.
Figure 11:
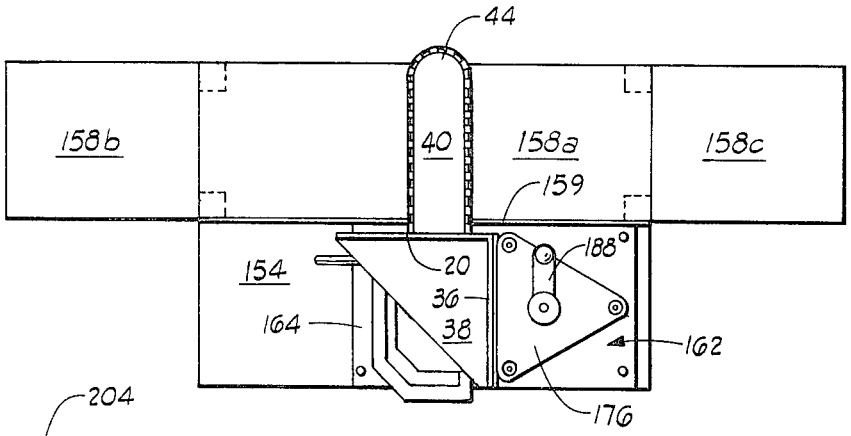
FIG. 11 is a plan view of the apparatus illustrated in FIG. 10.
Figure 15A:
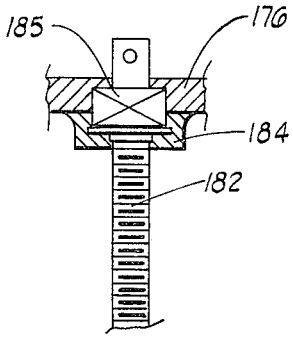

FIG. 15*a* is a detail structural view, partially in section and partially in elevation, depicting the manner in which a threaded adjusting shaft used in the embodiment of the invention shown in FIGS. 10 and 11 is constructed, and is mounted in an upper bearing included in the apparatus.

Figure 14:
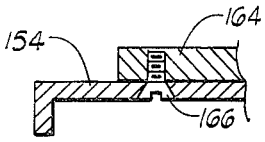
FIG. 14 is a detailed structural view illustrating the manner in which a base casting forming a portion of the invention is secured to a saw supporting plate forming a part of the base of one of the embodiments of the invention.
Figure 15B:
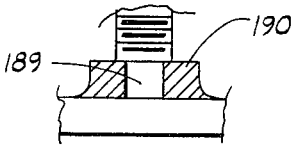

FIG. 15*b* is a view similar to FIG. 14*a*, but instead illustrating the bottom bearing mounting of the threaded shaft shown in part in FIG. 15*b*.

DETAILED DESCRIPTION OF PREFERRED EMBODIMENTS OF THE INVENTION

Figure 1:
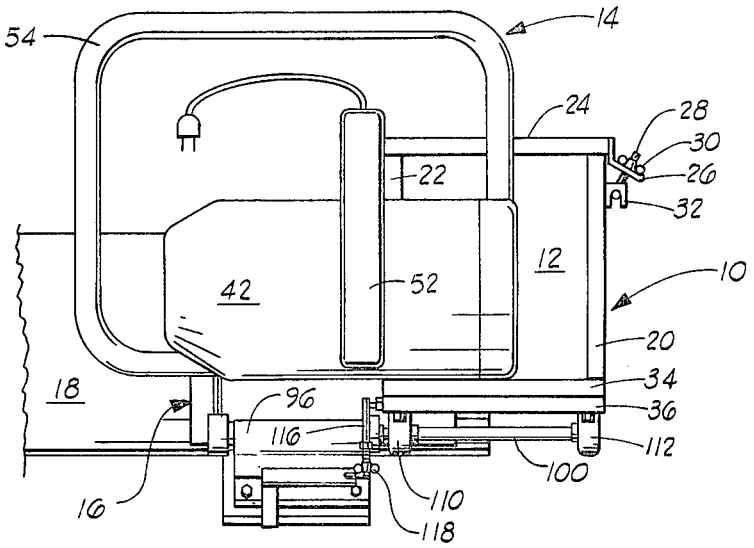
FIG. 1 is a back side elevation view of the variable utility chain saw apparatus of the invention as it appears when viewed from a side thereof opposite the side on which a log to be cut is located.

In FIG. 1 of the drawings, a variable utility chain saw apparatus constructed in accordance with the present invention is illustrated. The apparatus includes a mounting frame, designated generally by reference numeral 10, a mounting plate 12 which is removably carried in the mounting frame 10 in a manner hereinafter described, and a portable chain saw designated generally by reference numeral 14. A supporting assembly 16 is utilized for mounting the chain saw apparatus to a structure to be cut with the blade of the saw, and such structure, for illustration and discussion purposes, is portrayed as a log or timber 18. The supporting assembly 16 is movably and adjustably connected to the mounting frame 10 in a manner hereinafter described.

Referring in detail to the various structural elements included in the variable chain saw apparatus, the mounting frame 10 includes a pair of parallel side frame members 20 and 22, the side frame members 20 and 22 are of open channel, C-shaped cross-sectional configuration and form the opposite sides of the mounting frame in a construction of the type described in my U.S. Application Ser. No. 741,716. A top frame member 24 is pivotally secured at one of its ends to the side frame member 22, and carries a bifurcated locking flange 26 at its opposite end. The bifurcated locking flange 26 is positioned to project downwardly along the side frame member 20 for engagement with a threaded locking bolt 28 having a locking wing nut 30 threaded thereon. The locking bolt 28 is pivotally retained in a suitable bracket 32 which is secured to the outer side of the side frame member 20. The mounting frame 10 further includes a bottom frame member 34 which extends between the lower ends of the side frame members 22 and 20 to complete a generally rectangular configuration in the mounting frame. The oppositely facing channels consituted by the side frame members 22 and 20 function to receive the mounting plate 12 in the manner described in my co-pending Application Ser. No. 741,716, and hereinafter described in greater detail.

A second portion of the mounting frame 10 includes a large rectangular support flange 36 which projects normal to the plane of that portion of the mounting frame formed by the side frame members 20 and 22, the top frame member 24 and the bottom frame member 34. The support flange 36 is supported and reinforced by an angular gusset plate 38 which is secured between the side frame member 20 and one side edge of the support flange 36 in the manner best illustrated in FIG. 4.

Figure 4:
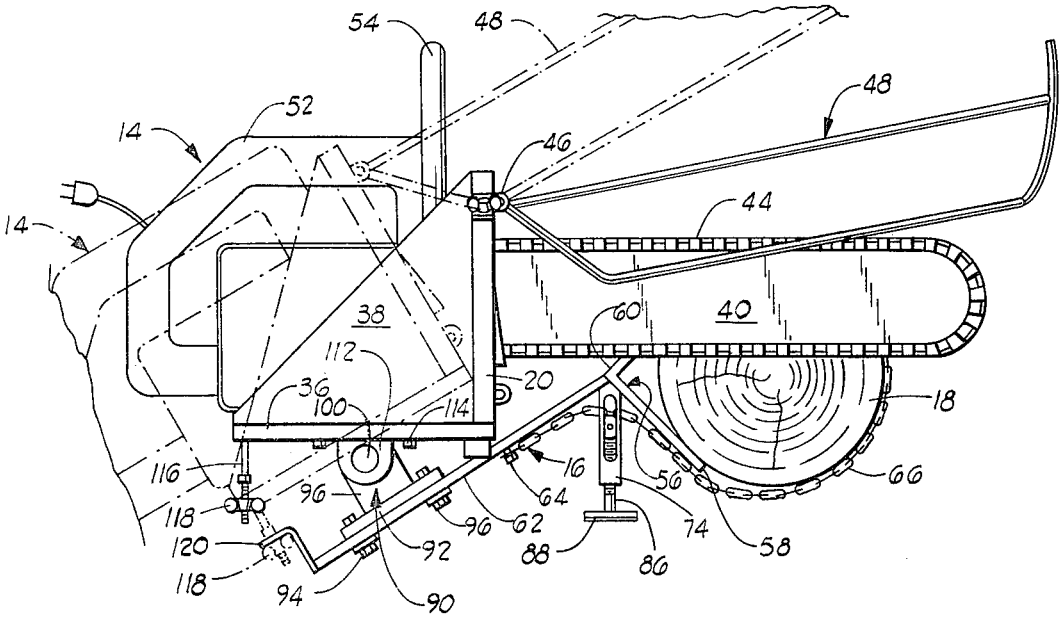
FIG. 4 is a view in elevation of the variable utility chain saw apparatus shown in FIGS. 1–3 as the apparatus appears when viewed from a side thereof which is displaced 90° from the side perceived in FIGS. 1 and 2. An alternate position of the apparatus when it is secured against a cutting operation is shown in dashed lines.

The mounting frame 10 is utilized to stably support and mount the portable chain saw 14 in substantially the same fashion as is described in my co-pending Application Ser. No. 741,716. The chain saw 14 includes the usual saw guide plate 40, which is a flat elongated metallic plate having relatively straight parallel side edges and a rounded outer end of typical construction well known to those skilled in the art. A motor or engine 42 is provided and is used for driving a flexible saw blade 44 trained around and guiding upon the opposed parallel edges and curvilinear end of the saw blade guide plate 40, as illustrated in FIG. 4. The saw blade guide plate 40 and chain saw blade 44 extend through a slot (not visible) provided centrally in the rectangular mounting 12 so that the engine 42 is positioned on one side of the mounting plate, and the guide plate 40 and saw blade 44 extend substantially normal to the other side of the mounting plate.

The chain saw 14 further includes means 46 pivotally supporting a blade guard subassembly 48. The blade guard and the means by which it is pivotally supported on the mounting plate 12 are preferably substantially the same, in general construction, as the corresponding elements illustrated in my U.S. Application Ser. No. 741,716. Thus, the chain saw guard subassembly 48 is free to pivot upwardly as may be required to permit the chain saw blade 44 and the guide plate 40 upon which it is mounted to move through the log 18 during cutting. An identical chain saw guard subassembly (not shown) can be mounted at the lower side of the mounting plate 12 to protect the lower or return run of the saw blade 44 when the chain saw is to be used in the field, and for this purpose, a second supporting means 40 similar to the supporting means 46 is provided at the lower side of the mounting plate 12.

The chain saw 14 is further provided with a conventional handle 52 which is secured to the housing of the motor 42, and with a safety brake bar 54 also of conventional construction.

When the portable chain saw 14 is to be utilized as a variable utility chain saw in conjunction with the remaining structure constituting a part of the present invention, the top frame member 24 of the mounting frame 10 is opened up by release of the latching element constituted by the threaded locking bolt 28 and is pivoted back so that the open channels constituted by the side frame members 20 and 22 can receive the side edges of the mounting plate 12. The mounting plate 12 is then lowered into the mounting frame until it seats in the position illustrated in FIGS. 1–4, at which time the top frame member 24 is re-closed, and is latched shut to lock the mounting plate in the mounting frame 10.

Figure 2:
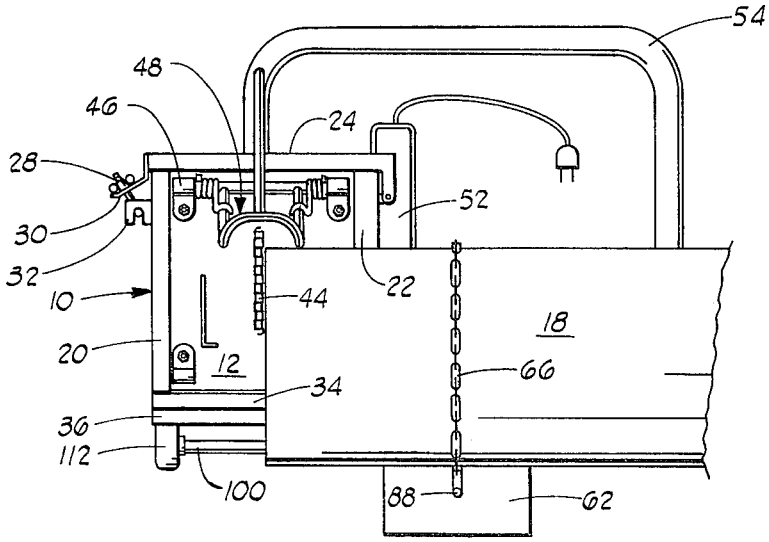
FIG. 2 is a front side elevation showing the variable utility chain saw apparatus of the invention as it appears on the side upon which a log is located, and illustrating the position of the apparatus as the saw blade is cutting through the log.
Figure 3:
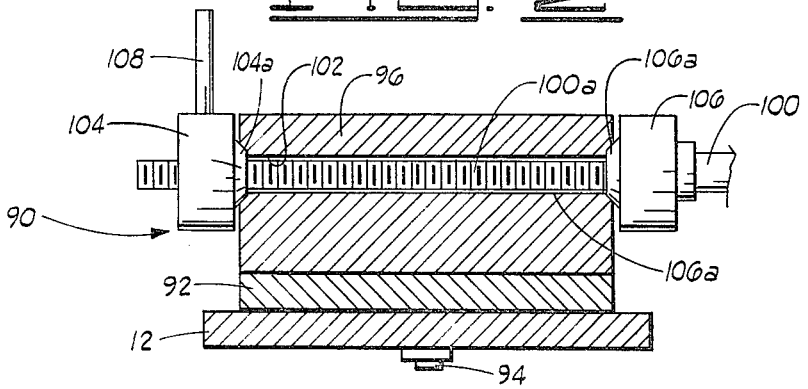
FIG. 3 is a plan view of the apparatus illustrated in FIGS. 1 and 2 as the apparatus appears during the cutting through of a log.
Figure 3:
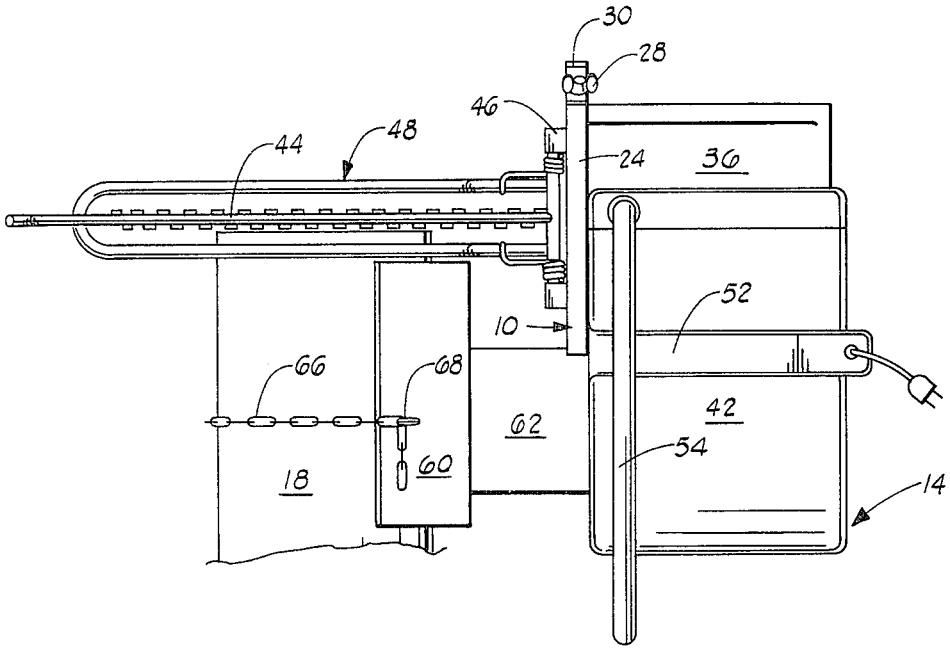

The support flange 36 of the mounting frame 10 is pivotally and adjustably secured to the supporting assembly 16. The supporting assembly includes an angulated base fork, designated generally by reference numeral 56, which base fork includes a pair of divergent flanges 58 and 60. The flanges 58 and 60 preferably extend at an angle slightly larger than 90° to each other, and provide an open mouth which wedgingly receives the log or timber 18 or other structure to be cut by the use of the variable utility chain saw apparatus in a manner hereinafter described. The supporting assembly 16 further includes a spacing plate 62 which is joined to the base fork 56 at the point of convergence of the flanges 58 and 60 and projects outwardly from the base fork and on its side opposite the angular opening between the flanges 58 and 60. The spacer plate 62 carries an anchor bolt 64 at an intermediate position thereon to afford a point of securement of one end of an elongated flexible fastening element, such as the chain 66, as illustrated in FIGS. 2–4. An open cleat 68 is welded to a side of the flange 60 opposite its side which encloses the angle of the base fork 56. The cleat functions to receive and engage any one of the links of the chain 66 which may be placed therein after the chain has been extended around a log 18 or other member to be cut with the saw apparatus.

Figure 7:
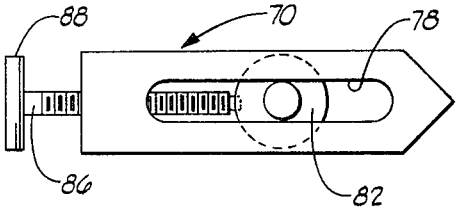
FIG. 7 is a detail view of an alternate side of the chain tensioning subassembly shown in FIG. 6.

For the purpose of tensioning the chain 66 in a way and for a purpose hereinafter described, a chain tensioning subassembly 70 is provided and is illustrated in detail in FIGS. 6 and 7. The chain tensioning subassembly 70 includes a pair of substantially parallel legs 72 and 74 which are interconnected at one end by a base block 76 and are open and spaced from each other at their opposite ends. The ends of the legs 72 and 74 opposite the base blocks 76 are tapered to a point so as to permit these legs to fit in, and register with, the angle formed between the flange 58 of the base fork 56 and the spacer plate 62 in the manner illustrated in FIG. 4. The pointed ends of the legs 72 and 74 are welded to the base fork 56 at this location. Each of the legs 72 and 74 is provided with an elongated slot 78 which slidingly receives the opposite ends of a shaft 80. The shaft 80 extends centrally through a cylindrical pressure block 82 which is peripherally recessed to receive a pin 84 carried on one end of a threaded tensioning shaft 86. The threaded tensioning shaft 86 is threaded through a central threaded bore formed through the base block 76 and has an operating knob 88 secured on the end thereof which is opposite the end carrying the pin 84. The chain 66 is extended between the legs 72 and 74 on the opposite side of the pressure block 82 from the threaded shaft 86 as illustrated in FIG. 4.

At the outer end of the spacing plate 62, an adjustable pedestal subassembly 90 is movably supported on the spacer plate and includes a slide plate 92 which is slidably mounted on the spacer plate. Lock nut assemblies 94 and 96 extend through the slide plate 92 and through an elongated slot (not visible) in the center of the spacer plate 62 and extending toward the end thereof which is connected to the base fork 56. The lock nut assemblies 94 and 96 permit the position of the slide plate 92 along the spacer plate 62 to be adjusted for a purpose hereinafter to be described.

Figure 5:
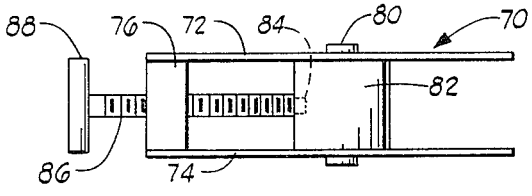
FIG. 5 is a detail view illustrating an adjustable position setting shaft and bearing subassembly used in the chain saw apparatus.

A shaft hub 96 (see FIG. 1) is rigidly supported on and above the slide plate 92. The shaft hub 96 is centrally bored to permit it to receive the threaded end portion 100*a* of an elongated mounting and adjusting shaft 100. The bore through the shaft hub 96, which bore is denominated by reference numeral 102, is larger in its diameter than the largest diameter of the threads carried on the threaded end portion 100*a* of the mounting and adjusting shaft 100, as illustrated in FIG. 5. As further illustrated in that Figure, each end of the bore 102 terminates in a frusto-conical countersunk cavity or recess. The countersunk, frusto-conical cavities disposed at each end of the bore 102 allow a pair of threaded adjusting nuts 104 and 106 to be wedgingly seated in these cavities by means of frusto-conically shaped protuberances 104*a* and 106*a*, respectively, carried thereon. The adjusting nuts 104 and 106 are internally threaded for threading upon the threaded end portion 100*a* of the mounting and adjusting shaft 100. The adjusting nut 104 has secured thereto, and projecting radially outwardly therefrom, an adjusting handle 103 which permits this adjusting nut to be tightened on the threaded end portion 100*a* of the mounting and adjusting shaft 100 in a way and for a purpose hereinafter described.

The mounting and adjusting shaft 100 projects from the shaft hub 96 through the pair of journal bearing pillow blocks 110 and 112. The journal bearing blocks 110 and 112 are, as best illustrated in FIGS. 1 and 4, secured by nuts 114 and associated bolts to the bottom side of the support flange 36. This construction enables the journal bearing blocks 110 and 112 to be removed from the support flange 36 in one mode of usage of the apparatus of the invention to be hereinafter described.

During the use of the variable utility chain saw apparatus illustrated in FIGS. 1–7, it is at times desirable to latch the chain saw 14 in a position in which the saw blade 44 is not in contact with the workpiece. For this purpose, a latching bolt 116 is pivotally connected to one corner of the support flange 36 and hangs downwardly therefrom. The latching bolt 116 carries a wing nut 118, and this nut can be used for engaging the latching bolt with a notched latching clip or bracket 120 which is secured to the free outer end of the spacing plate 62. When the wing nut 118 is engaged with the latching clip 120 in this manner, the chain saw 14 is retained in the position illustrated in dashed lines in FIG. 4.

Operation of the Invention Illustrated in FIGS. 1–7

The embodiment of the invention illustrated in FIGS. 1–7 is particularly useful in the field for cutting transversely through an elongated log or timber, with the cut being precisely flush with respect to the longitudinal axis of the timber and at the exact location desired. As an example of where such capability is quite useful, such precision cutting would be necessary, or at least highly desirable, in the construction of a log dwelling.

In preparing to cut through the log or timber 18 in the manner described, the base fork 56 of the supporting assembly 60 is initially placed so that the angle defined by the flanges 58 and 60 receives the cylindrical outer surface of the log 18, and the spacing plate 62 projects outwardly from the base fork in a direction such that the chain saw 14 will be clear of the ground or any other obstructions, and can be manipulated to cut through the log in a manner hereinafter described. The apparatus is then firmly secured to the log by extending the chain 66 through the spaced legs 72 and 74 of the chain tensioning subassembly 70, around the log and then hooking one link of the chain over the open cleat 68.

At this time, the cylindrical pressure block 82 is retracted to a location relatively near to the base block 76 so that when the operating knob 88 is later rotated to move the pressure block 82 toward the pointed ends of the legs 72 and 74, the chain will be tensioned, and will firmly grip the log 18 and force it against the flanges 58 and 60. When the chain tensioning subassembly 70 has been used to very tenaciously engage the log 18, the precise position of the saw 14, and more specifically the blade 44, is then adjusted so that the blade will cut through the log at the precise location desired. One such adjustment is effectd by the use of the slide plate 92 and the adjustable pedestal subassembly 90. To advance the blade toward or away from the log 18, the slide plate can be moved along the spacing plate 62 toward or away from the angulated base fork 56. For the purpose of adjusting the precise axial position of the blade 44 along the axis of the log 18, the adjusting nuts 104 and 106 are used in conjunction with the threaded end portion 100*a* of the mounting and adjusting shaft 100 and the shaft hub 96 through which it extends. More specifically, in order, for example, to shift the chain saw 14 and its blade 44 slightly to the right as the saw is viewed in FIG. 1, the adjusting handle 108 is used to loosen the adjusting nut 104 on the threaded end portion 100*a* of the shaft 100 and the adjusting nut 106 is also backed off on the shaft toward the right as the adjusting shaft and this nut are viewed in FIG. 5. The chain saw 14, its mounting plate 12 and also the mounting frame 10 and support flange 36 can all then be pulled or shifted toward the right relative to the shaft hub 96 until the blade 44 is at the precise location where it is desired to cut through the log. At this time, the adjusting nut 106 is threaded outwardly on the threaded end portion of the shaft 100 until the frusto-conical hub portion 106*a* thereof seats in the countersunk frusto-conical recess in the shaft 96. The adjusting nut 104 is then tightened by the use of the adjusting handle 108 so that the saw 14 and its blade 44 are locked in the selected position to effect the desired cut through log 18.

During the described manipulations of the variable utility chain saw apparatus of the invention, it is usually desirable to latch the chain saw in its inoperative position, as illustrated in dashed lines in FIG. 4. For accomplishing this, the latching bolt 116 is pivoted to a position such that it can pass through the bifurcation in the notched latching clip 120, and the wing nut 118 is then tightened to secure the latching bolt in this position of engagement with the latching clip. After the adjustments of position are made, the latching bolt is released from engagement with the latching clip, and the handle 52 is then used for pivoting the chain saw about the pivotol axis which coincides with the axis of the mounting and adjusting shaft 100 where this shaft passes through the journal bearing blocks 110 and 112.

As the saw blade 44 cuts through the log 18, the blade guard subassembly 48 pivots upwardly to whatever extent may be required to permit the blade to pass freely through the log. At the same time, the blade guard subassembly continues to protect the exposed surface of the upper run of the blade 44 from contact by the saw operator.

When it is desired to use the apparatus in a conventional fashion, as portable chain saws are generally used, the chain saw 14 can be easily detached from the supporting assembly 16 and from the mounting frame 10 by opening the mounting frame by pivotation to the open position of the top frame member 24, as previously explained, and lifting the saw 14 and its mounting plate 12 out of the mounting frame. The saw is now ready for conventional field use. If desired, a second blade guard subassembly 48 can be pivotally mounted in the second guard assembly supporting means 50 as described in my co-pending Application Ser. No. 741,716.

Figure 8:
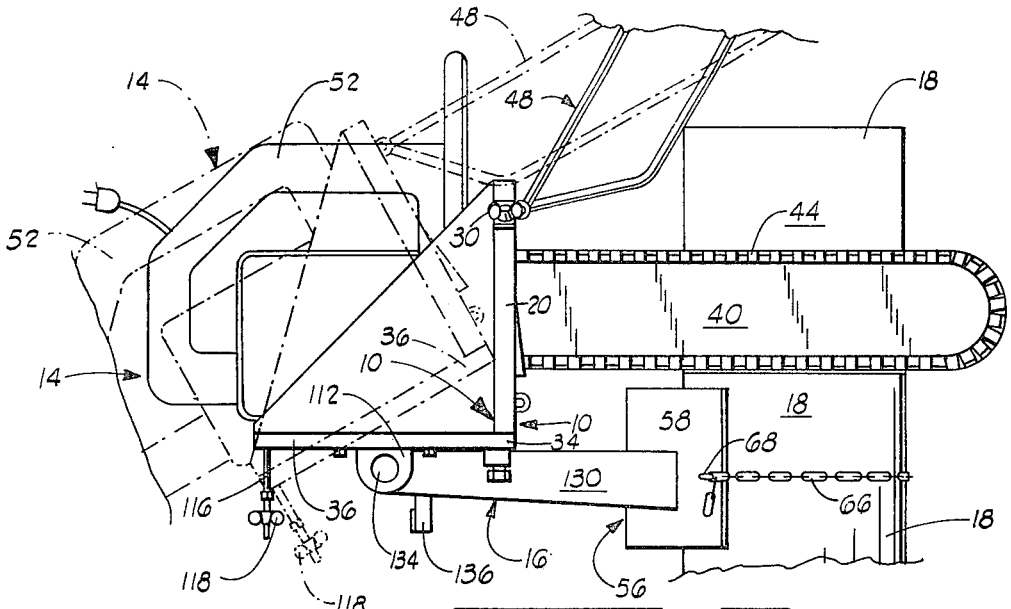
FIG. 8 is a side elevation view of an alternate embodiment of the variable utility chain saw apparatus of the invention, and illustrating the saw apparatus as it is used for notching a cylindrical workpiece by cutting in a plane extending along, or parallel to, the longitudinal axis of the workpiece.
Figure 9:
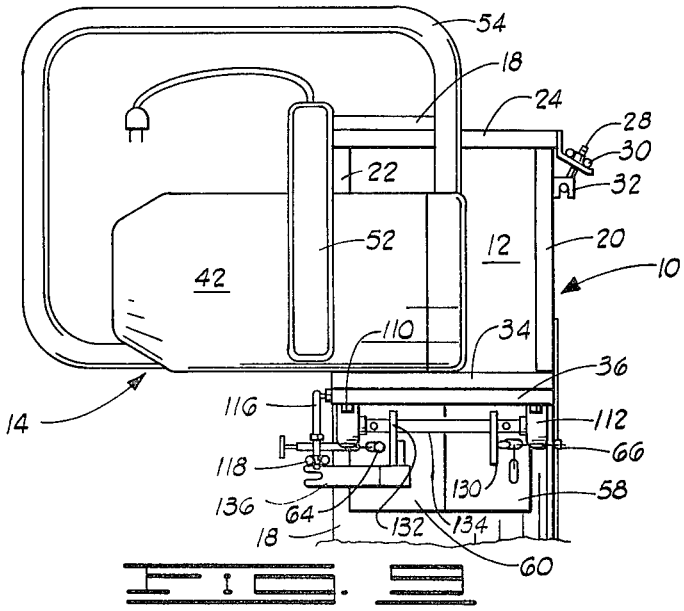
FIG. 9 is a back side elevation view of the embodiment of the invention illustrated in FIG. 8, similar to the corresponding view of the first embodiment thereof as illustrated in FIG. 1.

The Embodiment of FIGS. 8 and 9

A modified embodiment of the invention is illustrated in FIGS. 8 and 9 of the drawings. Since the embodiment of the invention here illustrated includes a number of structural elements which are identical in construction and arrangement to corresponding elements in the embodiment of the invention shown in FIGS. 1–7, identical reference numerals are used in referring to identical parts as the embodiment of FIGS. 8 and 9 is described. Thus, the variable utility chain saw apparatus of the invention includes the mounting frame 10 which removably receives a mounting plate 12 carrying a portable chain saw 14. The chain saw includes the chain saw guide plate 40, motor 42, flexible saw blade 44, guard subassembly 48 and conventional handle 52, all as previously described.

The mounting frame 10 is constructed as previously described, and thus includes a support flange 36 which projects substantially normal to the side frame members 20 and 22. As previously indicated, the mounting frame is movably carried on a supporting assembly 16. In the embodiment of the invention illustrated in FIGS. 8 and 9, however, the supporting assembly 16 is constructed differently from the supporting assembly 16 employed in the first described embodiment of the invention. Basically, the variations in structure of the supporting assembly 16 utilized in the embodiment of the invention shown in FIGS. 8 and 9 are present in order to permit the chain saw apparatus to be utilized for notching or, stated differently, cutting a timber or log along a plane of cut which extends coincident with, or parallel to, the longitudinal axis of the log.

In FIGS. 8 and 9, the log to be cut is again designated by the reference numeral 18. The supporting assembly 16 here used includes an angulated base fork 56 which includes divergent flanges 58 and 60. A chain 66 is secured to an anchor bolt 64 and to an open cleat 68 for extension around the log 18 in the manner hereinbefore described. Projecting out from the angulated base fork 56 are a pair of spaced, substantially parallel support plates 130 and 132. The support plates 130 and 132 engage and support, at spaced locations therealong, a shaft 134 which is journalled in the journal bearing blocks 110 and 112 secured to the underside of the support flange 36 in the manner hereinbefore described. It will be noted that a modification to the type of shaft supported between the journal bearing blocks 110 and 112 from that type of shaft used in the embodiment shown in FIGS. 1–7 adapts the mounting frame 10 for connection to, and support by, the supporting assembly 16 as required in the embodiment of FIGS. 8 and 9.

For the purpose of latching the saw apparatus in an inoperative position, a latching clip 136 is welded or otherwise suitably secured to the support plate 132 at a location such that the latching clip can be engaged by the wing nut 118 carried on the latching bolt 116. The latching bolt is pivotally connected to a corner of the support flange 36 in accordance with the construction previously described.

The embodiment of the invention illustrated in FIGS. 8 and 9 permits the chain saw 14 to be stably mounted on the log 18 so that a notch cut extended in a plane substantially parallel to the longitudinal axis of the log can be made at a selected location or angle with respect to the periphery of the log. In other respects, the manner in which the chain saw apparatus is utilized is substantially the same as that previously described in referring to the embodiment illustrated in FIGS. 1–7. The ease with which the apparatus can be changed from the form shown in FIGS. 1–7 to that used in FIGS. 8–9 permits alternate field usage with little time delay in making the needed changeover. The particular type of supporting assembly 16 utilized in the embodiment in FIGS. 8 and 9 is relatively light in weight, and can be transported to the field location where cutting is to be effected, along with the supporting assembly of the type employed in the embodiment of the invention shown in FIGS. 1–7.

Yet another embodiment of the present invention is illustrated in FIGS. 10–15.

The Embodiment of FIGS. 10–15

A further embodiment of the variable utility chain saw apparatus is illustrated in FIGS. 10–15. As shown in FIG. 10, the embodiment of the apparatus here depicted includes a saw bench, designated generally by reference numeral 150. The saw bench includes a base 152 adapted to be supported upon a floor. A saw supporting plate 154 of generally rectangular configuration is retained on the base by downwardly extending flanges 155 and by a centrally disposed hold-down bolt 157. A plurality of vertically extending stanchions 156 extend upwardly from a projecting portion of the base 152 to support a workpiece table 158. The workpiece table 158 extends horizontally at a vertical level spaced upwardly from the base 152, and includes a central portion 158*a* and a pair of hinged leaves 158*b* and 158*c*. The leaves 158*b* and 158*c* can be folded outwardly to a position of horizontal alignment with the central portion 158*a* as shown in FIGS. 10 and 11. When not in use, the leaves can be folded downwardly to a position in which they extend parallel to stanchions 156. A ripping fence 159 projects upwardly from one edge of the central portion 158*a* and has a central opening therein to permit the saw blade 44 to be extended therethrough.

Supported upon the supporting plate 154 of the base 152 is the variable utility chain saw apparatus of the invention. In this embodiment of the apparatus, the chain saw 14, mounting frame 10 and mounting plate 12 are retained in a fixed position in which the chain saw guide plate 40 extends in a horizontal plane.

For supporting the chain saw in this orientation, the supporting flange 36 forming a part of the mounting frame 10 is oriented in a vertical plane, as illustrated in FIG. 11, and is adjustably positioned in a vertical direction by means of a screw jack assembly designated generally by reference numeral 162. The screw jack assembly includes a base casting 164 which is secured by means of the hold-down bolt 157 and countersunk flat head screws 166 to the plate 154 as shown in detail in FIG. 12. The base casting 164 includes three hub elements 168 which function as sockets receiving the lower ends of vertically extending supporting posts 172, 174 and 175. The three posts 172, 174 and 175 are located in a triangular array. A triangular cap plate 176, carrying downwardly opening hubs 178, 180 and 181 for receiving the upper ends of the supporting posts 172, 174 and 175 is secured to the upper ends of the posts after these have been inserted in the hubs.

To provide for the elevation of the chain saw to a selected elevation for cutting a workpiece, a threaded screw shaft 182 is provided between the vertically extending supporting posts and has its upper end journalled in a journal boss 184 provided on the lower side and at the center of the cap plate 176. The upper end of the screw shaft 182 is extended through a bearing 185 positioned inside the journal boss 184 as illustrated in FIG. 15*a* of the drawings. An operating handle 188 is keyed to the upper end of the shaft to rotate the shaft about its axis. The lower end of the screw shaft 182 carries a downwardly projecting pin 189 which seats in a registering recess formed in a socket boss 190 cast as a part of the base casting 164.

Elevation and lowering of the saw is caused to occur when the screw shaft 182 is rotated by the use of the handle 188 as a result of the movements up and down the screw shaft of a threaded follower sleeve 192 which includes a central threaded bore carrying threads engaging the threads of the screw shaft. The follower sleeve 192 has a plurality of radially projecting spokes 194 which extend radially outwardly from the outer periphery thereof and are secured at their outer ends to guide sleeves 196. Each of the three guide sleeves 196 concentrically surrounds one of the vertically extending posts 172, 174 and 175 as is shown in the case of the posts 172 and 174 in FIG. 10.

Figure 12:
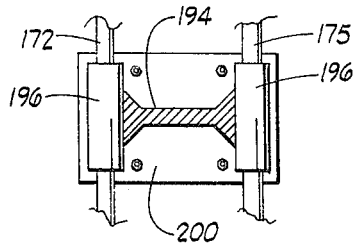
FIG. 12 is a sectional view taken along line 12—12 of FIG. 10.

As illustrated in FIG. 12, the two guide sleeves 196 which slidably engage and concentrically surround the posts 172 and 175 are secured to a vertically extending attachment plate 200. The attachment plate 200 is provided with a plurality of bolt apertures facilitating the extension of bolts therethrough to permit bolting of the attachment plate 200 to the support flange 36 of the mounting frame 10. The support flange 36 and mounting frame 10 are constructed as previously described, and function to support and carry the chain saw 14 and mounting plate 12 in the manner hereinbefore described. In the securement of the attachment plate 200 to the support flange 36, the journal bearing blocks 110 and 112 are first removed from the support flange 36, and the threaded bolt holes which receive the bolts normally used to retain the journal bearing blocks on the support flange are then used to receive the threaded shanks of bolts which are extended through the bolt apertures in the attachment plate 200.

When the chain saw 14 has been mounted on the saw jack assembly 162 in the manner described, it will be seen that the saw blade 44 extends in a horizontal plane over the central portion 158*a* of the work table 158. It is thus positioned to cut through a workpiece moved along the table of the saw bench 150. The horizontal plane occupied by the saw blade 44 can be vertically adjusted by turning the handle 188 so as to cause rotation of the screw shaft 182. This will raise or lower the follower sleeve 192 and with it, the attachment plate 200, mounting frame 10 and the chain saw 14. In this way, cuts through a workpiece can be effected in various vertically spaced horizontal planes as may be desired.

Figure 13:
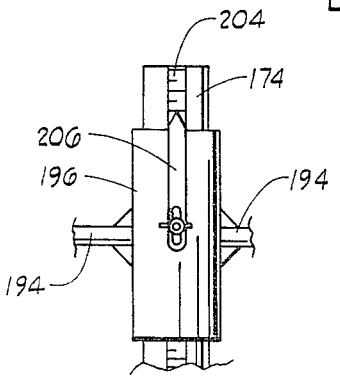
FIG. 13 is a detail view illustrating a measuring scale forming a part of the embodiment of the invention illustrated in FIGS. 10 and 11.

For the purpose of providing a precise indication of the amount by which the chain saw 14 is raised or lowered, a scale 204 is provided along a flat surface ground on the outer side of the vertically extending post 174 as shown in FIG. 13. A pointer 206 is mounted upon the sleeve 196, also as shown in FIG. 13, to provide a precise visual indication of the amount by which the saw is raised or lowered.

Although certain preferred embodiments of the invention have been herein described in order to apprise those skilled in the art of the principles which underlie the invention, various changes and innovations in the illustrated and described structure can be effected without departure from such basic principles. Changes and innovations of this type are therefore deemed to be circumscribed by the spirit and scope of the invention, except as the same may be necessarily limited by the appended claims or reasonable equivalents thereof.

What is claimed is:

1. A variable utility chain saw apparatus comprising:

a mounting frame;

a slotted mounting plate removably carried on the mounting frame;

a chain saw secured to the mounting plate and removable from the mounting frame with the mounting plate and including:

a saw blade guide plate projecting through the slot in the mounting plate;

a motor connected to the guide plate and located on one side of the mounting plate;

a saw blade drivingly connected to the motor and extending around the guide plate at a location at which substantially all of the saw blade is on the opposite side of said mounting plate from said motor; and a chain saw guard subassembly pivotally mounted on one side of the mounting plate, and projecting over the saw blade; and a supporting assembly connected to the mounting frame and adapted for quick-detachable securement to a stabilizing structure of stabilize the saw during cutting.

2. A variable utility chain saw apparatus as defined in claim 1 wherein said mounting frame includes:

side frame members adapted to slidingly receive said mounting plate; and a supporting flange connected to, and projecting from, the side frame members and connected to said supporting assembly.

3. A variable utility chain saw apparatus as defined in claim 1 wherein said supporting assembly comprises:

an angulated base fork adapted to engage a cylindrical surface; and a spacing plate connected to said angulated base fork and to said mounting frame and positioned to support the mounting frame, mounting plate and chain saw upon said cylindrical surface and free of all other support when said angular fork is engaged with said cylindrical surface.

4. A variable utility chain saw apparatus as defined in claim 3 and further characterized as including:

a flexible member connected to said base fork and defining a bight configured for partial encirclement of said stabilizing structure; and means for tensioning said flexible member.

5. A variable utility chain saw apparatus as defined in claim 1 and further characterized as including means for releasably latching said mounting frame to said supporting assembly to position said saw blade at a selected angle and out of contact with said stabilizing structure.

6. A variable utility chain saw apparatus comprising:

a mounting frame;

a slotted mounting plate removably carried on the mounting frame;

a chain saw secured to the mounting plate and including:

a saw blade guide plate projecting through the slot in the mounting plate;

a motor connected to the guide plate and located on one side of the mounting plate;

a saw blade drivingly connected to the motor and extending around the guide plate; and a chain saw guard subassembly pivotally mounted on one side of the mounting plate, and projecting over the saw blade;

a supporting assembly adapted for securement to a stabilizing structure to stabilize the saw during cutting and including:

an angulated base fork adapted to engage a cylindrical surface forming a part of the stabilizing structure;

a spacing plate connected to said angulated base fork; and an adjustable pedestal subassembly secured to said spacing plate and adjustably connected to said mounting frame, said adjustable pedestal subassembly including:

a slide plate movably mounted on said spacing plate for movement toward and away from said angulated base fork;

a centrally bored shaft hub secured to said slide plate;

a mounting and adjusting shaft extending through the central bore in said shaft hub and including a threaded end portion and a second end portion pivotally connected to said mounting frame; and a pair of adjusting nuts threaded on the threaded end portion of said mounting and adjusting shaft and engageable with opposite sides of said shaft hub at opposite ends of the bore therethrough.

7. A variable utility chain saw apparatus as defined in claim 14 wherein said mounting frame comprises:

side frame members adapted to slidingly receive said mounting plate; and a supporting flange connected to, and projecting from, the side frame members and connected to said second end portion of said mounting and adjusting shaft.

8. A variable utility chain saw apparatus as defined in claim 7 wherein said supporting assembly further includes journal bearing blocks connected to said supporting flange and pivotally receiving said second end portion of said mounting and adjusting shaft.

9. A variable utility chain saw apparatus comprising:

a portable chain saw including a motor;

a guide plate;

a saw blade entrained around the edge of the guide plate; and a handle;

a mounting plate supporting the chain saw to position the motor handle on one side of the mounting plate and the saw blade and guide plate on the other side of the mounting plate;

mounting means for slidably and detachably receiving and mounting the mounting plate;

a supporting assembly pivotally supporting the mounting means to facilitate movement of the blade in a cutting plane, said supporting assembly comprising:

an angulated base fork including a pair of divergent flanges;

a spacing plate connected to said angulated base fork; and means movably interconnecting said spacing plate and mounting means to facilitate adjustment of the position of said saw blade by movement of the entire chain saw and mounting means in two directions relative to said spacing plate.

10. A variable utility chain saw apparatus comprising:

a mounting frame;

a slotted mounting plate removably carried on the mounting frame;

a chain saw secured to the mounting plate and including:

a saw blade guide plate projecting through the slot in the mounting plate;

a motor connected to the guide plate and located on one side of the mounting plate;

a saw blade drivingly connected to the motor and extending around the guide plate; and a chain saw guard subassembly pivotally mounted on one side of the mounting plate, and projecting over the saw blade;

a supporting assembly adapted for securement to a stabilizing structure to stabilize the saw during cutting; and an adjustable pedestal subassembly secured to said supporting assembly, said adjustable pedestal subassembly comprising:

a slide plate movably mounted on said supporting assembly for movement toward and away from said stabilizing structure when said supporting assembly is secured to said stabilizing structure;

a centrally bored shaft hub secured to said slide plate;

a mounting and adjustable shaft extending through the central bore in said shaft hub and including a threaded end portion and a second end portion pivotally connected to said mounting frame; and a pair of adjusting nuts threaded on the threaded end portion of said mounting and adjusting shaft and engageable with opposite sides of said shaft hub at opposite ends of the bore therethrough.

* * * * *

UNITED STATES PATENT AND TRADEMARK OFFICE

CERTIFICATE OF CORRECTION

PATENT NO. : 4,258,600
DATED : March 31, 1981
INVENTOR(S) : Edward L. Jackson

It is certified that error appears in the above-identified patent and that said Letters Patent are hereby corrected as shown below:

Column 1, line 6, "16" should be "15."

Column 5, line 45, "consituted" should be "constituted".

Column 8, line 53, "effectd" should be "effected".

Column 13, line 6, "of" should be "to".

Column 14, line 10, "14" should be "6".

Signed and Sealed this

*Thirty-first* Day of *August 1982*

[SEAL]

*Attest:*

GERALD J. MOSSINGHOFF

*Attesting Officer*

*Commissioner of Patents and Trademarks*